US007406814B2

(12) United States Patent
Morand

(10) Patent No.: US 7,406,814 B2
(45) Date of Patent: Aug. 5, 2008

(54) APPARATUS FOR PACKING DISPOSABLE OBJECTS INTO AN ELONGATED TUBE OF FLEXIBLE MATERIAL

(75) Inventor: Michel Morand, Montreal (CA)

(73) Assignee: International Refills Company Ltd., Christ Church (BB)

( * ) Notice: Subject to any disclaimer, the term of this patent is extended or adjusted under 35 U.S.C. 154(b) by 0 days.

(21) Appl. No.: 11/315,344

(22) Filed: Dec. 23, 2005

(65) Prior Publication Data

US 2006/0248862 A1 Nov. 9, 2006

(51) Int. Cl.
*B65B 9/10* (2006.01)

(52) U.S. Cl. ..... 53/567; 53/576; 220/495.05

(58) Field of Classification Search ..... 53/370, 53/459, 477, 551, 567, 576; 220/808.1, 495.05, 220/495.059

See application file for complete search history.

(56) References Cited

U.S. PATENT DOCUMENTS 3,619,822 A * 11/1971 Carmichael ..... 4/484
4,427,110 A * 1/1984 Shaw, Jr. ..... 206/205
4,869,049 A 9/1989 Richards et al.
5,385,259 A * 1/1995 Bernstein et al. ..... 220/495.11
5,590,512 A * 1/1997 Richards et al. ..... 53/567
6,003,162 A 12/1999 Kishi et al.
6,065,272 A * 5/2000 Lecomte ..... 53/576
6,170,240 B1 * 1/2001 Jacoby et al. ..... 53/567
6,370,847 B1 * 4/2002 Jensen et al. ..... 53/459
6,719,194 B2 * 4/2004 Richards ..... 232/43.1
6,722,107 B2 * 4/2004 Morand ..... 53/459
6,817,164 B2 * 11/2004 Mauffette et al. ..... 53/576
6,851,251 B2 2/2005 Stravitz et al.
6,925,781 B1 * 8/2005 Knuth et al. ..... 53/459
6,941,733 B2 * 9/2005 Chomik et al. ..... 53/576
6,974,029 B2 * 12/2005 Morand et al. ..... 206/303
2005/0193692 A1 9/2005 Stravitz et al.

FOREIGN PATENT DOCUMENTS

CA 2236361 5/1999
WO WO 96/34553 11/1996

* cited by examiner

*Primary Examiner*—Paul R Durand
(74) *Attorney, Agent, or Firm*—Ogilvy Renault LLP

(57) ABSTRACT

An apparatus for packing disposable objects or material into an elongated tube of flexible material. The apparatus defines a bin having a holder adapted to receive a cassette of flexible unfoldable material. A closing mechanism is positioned below the holder. The closing mechanism includes first and second portions. The second portion is biased in a closed position against the first. The second portion has a receiving surface and is slidable from the closed position to an open position through the application of a substantially downward force against the receiving surface and is slidable from the open position to the closed position under the action of a biasing force. The closing mechanism in the open position defines a passage between a top opening of the bin and a bottom portion of the enclosure, and in the closed position closes the passage.

23 Claims, 8 Drawing Sheets

APPARATUS FOR PACKING DISPOSABLE OBJECTS INTO AN ELONGATED TUBE OF FLEXIBLE MATERIAL

BACKGROUND OF THE INVENTION

1. Field of the Invention

The present invention relates to an apparatus for packaging disposable material or objects into a tube of flexible plastic film material. More specifically, the invention relates to an apparatus for use to package waste material, for example babie's disposable diapers, or any other kind of appropriate objects or material, into a tube of flexible plastic film material and to store the so packaged waste material in a hygienic and a substantially odor-free manner, until it is collected.

2. Background Art

Known apparatuses of the above-mentioned type generally comprise a container having an open or openable upper portion in which the waste to be disposed of may be inserted and a bottom portion in which the disposed waste is stored. A ring-shaped cassette is mounted in the upper portion of the container, and contains, in a pleated form, a tube of flexible plastic film material which is formed into an elongated tube which is knotted at a bottom end and into which the waste material may be inserted and temporarity stored.

In use, the waste to be disposed of is inserted into the tube at the upper portion of the container and the tube and waste are then pushed through the open center of the cassette towards the bottom portion of the container for storage purpose. Closeable means are also provided for closing the tube below the cassette and thus preventing bad odor from escaping from the tube during storage.

In Canadian patent No. 1,298,191, these closeable means are disclosed as a core that can be turned by a lid about a cylinder in order to twist the tube at regular intervals to form successive "pouches" that are kept sealed while they are stored.

In Canadian laid-open application No. 2,383,799, a squeezing device is mounted in the container below the cassette to pull the tube from the cassette and move it down together with the objects inserted into the container. This squeezing device comprises a pair of opposite rotatable members between which the tube is inserted. The rotatable members have a plurality of opposite bars extending transversely to the tube in order to squeeze the tube, keep it closed until other objects to be disposed of are inserted into the upper portion of the container, and pull it down to move the plastic film forming the tube and the objects contained therein towards the bottom portion of the container for storage purpose. Actuation of the rotatable members in unison and in opposite direction to achieve the requested squeezing, closing and pulling down of the plastic film tube is preferably obtained by actuation of a lever that is part of the container.

In Canadian laid-open application No. 2,441,837, a plunging device is provided to compress the object to be disposed of, and push it into the tube and to the bottom part of the container. The plunging device includes two arms with pivoting flaps attached thereto and opposing pivotable slides.

All of these prior art devices have several disadvantages. Their mechanisms have many parts and are prone to breakage. These devices are also not user-friendly and difficult to understand the operation thereof when first purchased. They are costly to fabricate and they utilize excess film from the cassettes adding to the cost of use. Some also do not effectively contain the odors of the disposed material.

SUMMARY OF INVENTION

It is therefore an aim of the present invention to provide an improved apparatus for packing disposable objects into an elongated tube of flexible plastic film material which is easy to use.

It is also an aim of the present invention to provide an improved apparatus for packing disposable objects into an elongated tube of flexible plastic film, and which apparatus is simple to assemble and have few moving parts.

It is a further aim of the present invention to provide an improved apparatus for packing disposable objects into an elongated tube which can use a lesser quantity of flexible plastic film packing material than in the prior art described above.

Another aim of the present invention is to provide an apparatus, as above-described, which prevents the accumulation of odors released from the disposable objects which are disposed in the elongated tube.

Therefore, in accordance with a broad aspect of the present invention, there is provided an apparatus for packing at least one disposable object into an elongated tube of flexible material. The apparaus comprises a bin defining an enclosure with an opening defined at a top thereof for receiving at least one disposable object to be packed. A holder is provided within the bin proximate the opening. The holder is adapted to receive a cassette of flexible unfoldable film providing an elongated film tube. A closing mechanism is located below the holder and comprises first and second portions. The second portion is biased in a closed position against the first portion and defines a receiving surface for receiving the at least one disposable object. The second portion is slidable from the closed position to an open position through application of a substantially vertical downward force against the receiving surface and being slidable from the open position to the closed position under the action of biasing means. The closing mechanism in the open position defines a passage between the opening of the bin and a bottom portion of the enclosure located below the closing mechanism. The closing mechanism in the closed position closes the passage.

Also in accordance with a further broad aspect of the present invention, there is provided an apparatus for packing at least one disposable object into an elongated tube of flexible material. The apparatus comprises a bin having an opening defined at a top portion thereof. A cassette holder is located proximate the top portion of the bin. A removable cassette, of unfoldable tubing of flexible material is received in the cassette holder. The tubing being pullable from the cassette and attached to form a closed bottom for an elongated tube of increasing length having an open top end aligned with the opening for receiving the at least one disposable object within the elongated tube. A closing mechanism is located below the holder and comprises at least one moveable part biased in a closed position and slidable between the closed position and an open position by pushing the at least one disposable object against the closing mechanism. The closing mechanism in the closed position, pinches the flexible material such as to seal the elongated tube from a remainder of the elongated tube below the closing mechanism. The closing mechanism, in the open position, allows the disposable object to be pushed within the bin below the closing mechanism.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
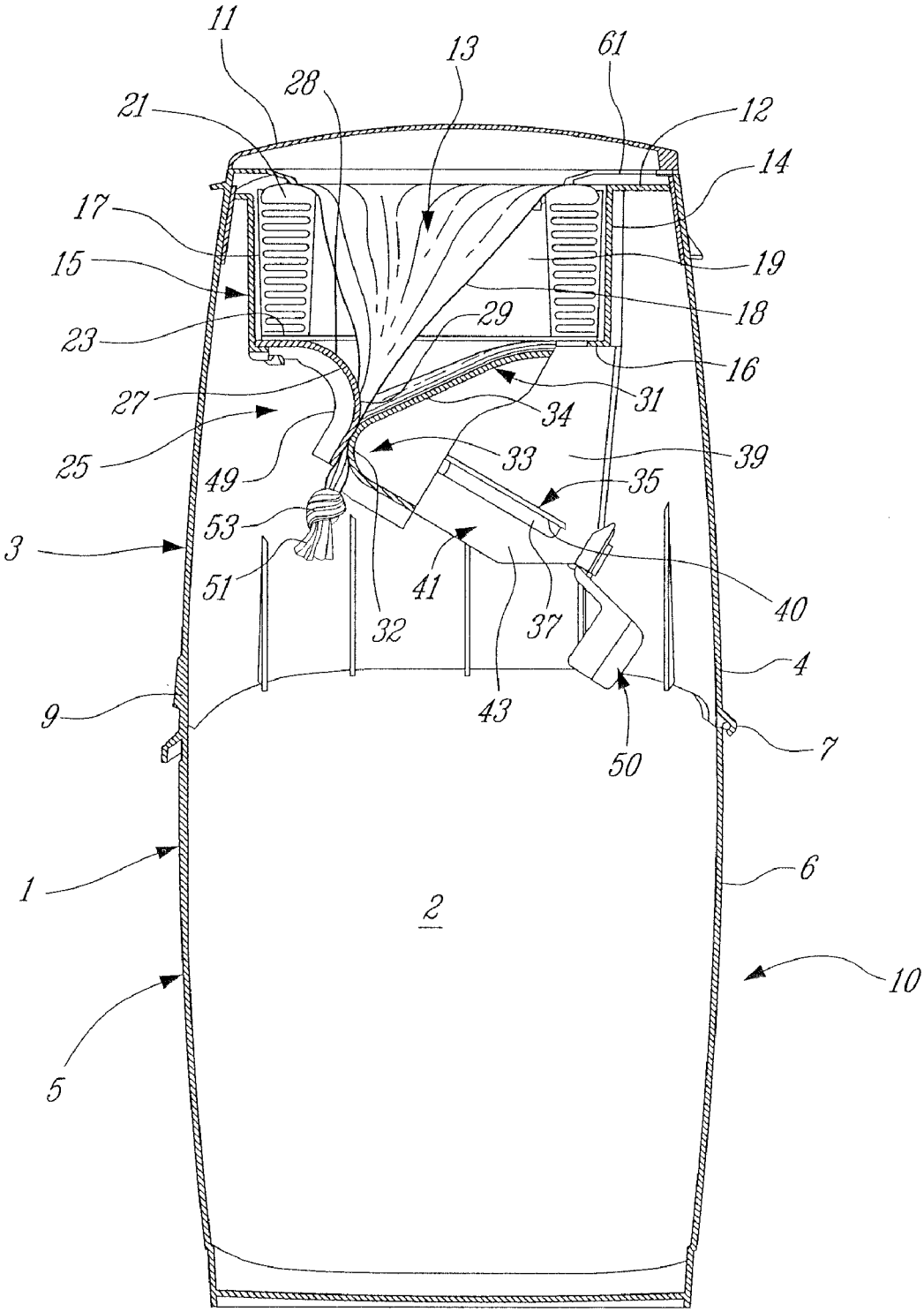
FIG. 1 is a cross-sectional view of an apparatus according to a particular embodiment of the invention.
Figure 2:
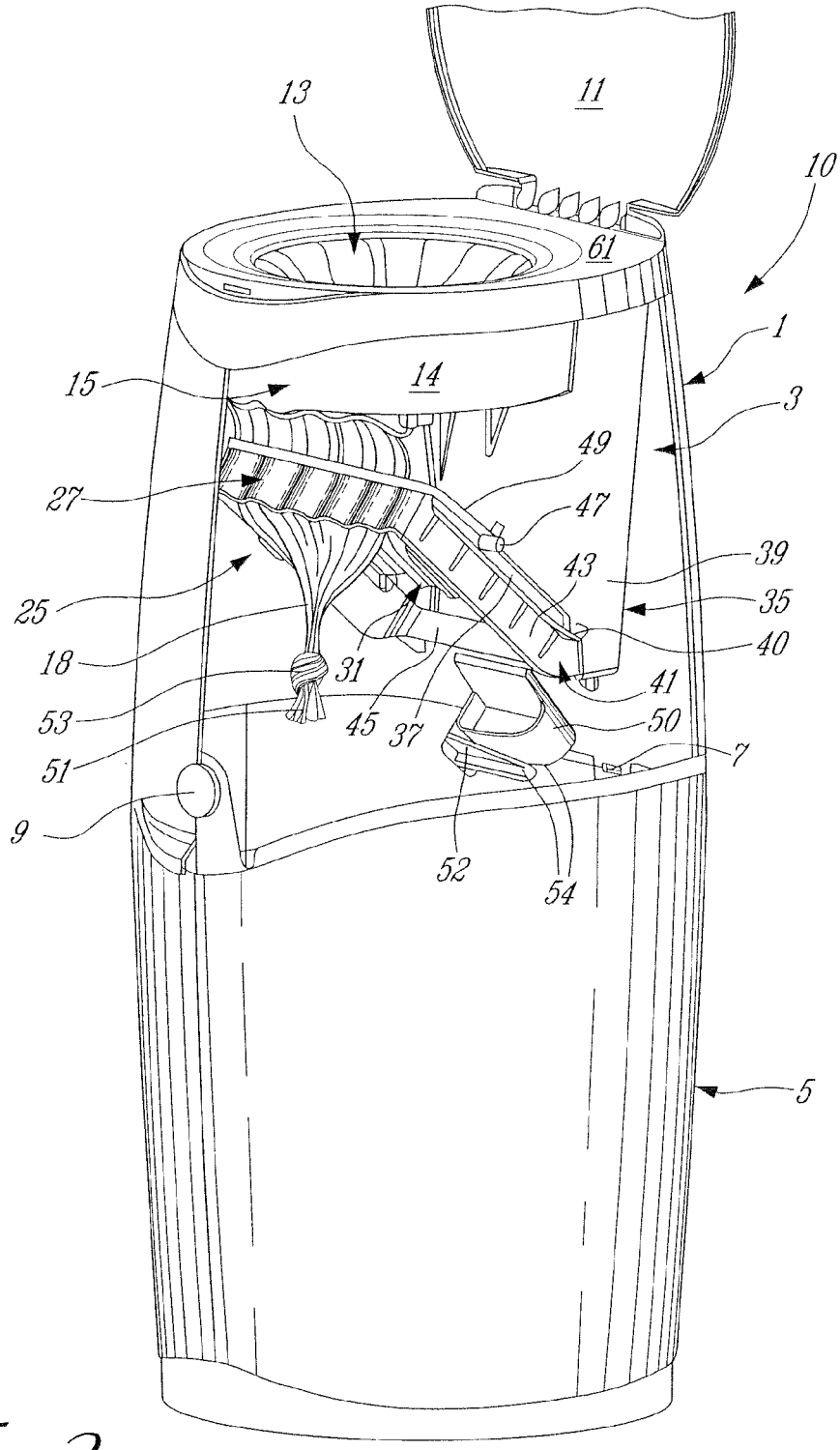
FIG. 2 is a perspective view of the apparatus of FIG. 1 with part of an outer wall thereof being omitted.

Referring to FIGS. 1-2, there is shown an apparatus 10 for packaging disposable objects in an elongated tube 18 of flexible plastic film material. The apparatus 10 comprises a bin 1 having a top portion 3 and a bottom portion 5 hingedly connected to each other by a hinge member 7, with outer walls 4,6 of the top and bottom portions 3,5 defining an enclosure 2 of the bin 1. In the embodiment shown, the top portion 3 and bottom portion 5 have substantially the same height, such that the hinge member 7 is located approximately at mid-height of the bin 1. Alternate configurations are also possible, as long as the various elements attached to the top portion 3 and described below do not interfere with the pivoting motion between the two portions 3,5. Such alternate configurations include, for example, the top portion 3 forming a major portion of the bin 1 with the bottom portion 5 forming a lesser portion.

The top and bottom portions 3,5 are locked together with a mechanism such as a push button latch 9, located opposite of the hinge member 7. Upon actuation of the push button 9, the top and bottom portions 3,5 are disconnected and can be pivoted apart about the hinge member 7 to provide access to the enclosure 2, for example to empty the bin 1.

The top portion 3 defines an opening 13 for receiving disposable objects therethrough, and the bin 1 further comprises a lid 11 hingedly connected to the top portion 3 such as to selectively open and close access to the opening 13. Although in the embodiment shown the apparatus has a generally circular opening 13, the present invention is not limited to circular openings and could function with openings of different shapes.

Still referring to FIGS. 1-2, the apparatus 10 also comprises a holder 15 located within the top portion 3 proximate the opening 13 for holding a cassette 17 of flexible unfoldable plastic film tubing 18, the cassette having a central opening 19 which is generally aligned with the bin opening 13. The cassette 17 has a top portion 21 and a bottom portion 23, and the flexible tubing 18 exits from the top portion 21 towards and beyond the bottom portion 23. It will be understood that such cassettes are well known in the art and essentially comprise a length of flexible plastic film material that is folded (see for example such a cassette shown in US patent application Ser. No. US2003/0121923). However, to better contain odors it is preferable that the film material be a multiple layer film having an odor barrier therein such that odors do not permeate through the film material.

In the embodiment shown, the holder 15 includes a top annular flange 12 extending inwardly from the top of the outer wall 4 of the top portion 3. A tubular vertical wall 14 extends downwardly from an inner end of the top annular flange 12. A bottom annular flange 16 extends inwardly from a bottom end of the tubular vertical wall 14, thus defining a seat where the cassette 17 is supported with the top portion 21 thereof substantially aligned with the top of the bin 1. The bottom annular flange 16 extends without substantially blocking the central opening 19 of the cassette 17 to avoid interference with the movement of the flexible tubing 18. One will also appreciate that the holder 15 may take many alternate shapes and forms. In an alternate aspect, the holder 15 could be a horizontal flange surrounding the opening 13, upon which the top portion 21 of the cassette 17 would rest. It is also understood that other types and geometries of cassettes 17 can be used with the present invention, and as such the holder 15 can take any alternate configuration adapted to the type of cassette 17 used.

Again referring to FIGS. 1-2, the apparatus 10 further includes a closing mechanism 25 whose purpose is to provide access to the flexible tubing extending therebelow and preventing odors from escaping from the flexible tubing 18. In one form of use, it permits the disposable objects to push down against the bottom of the tube to draw out the flexible tubing 18. One aspect of note is that the flexible tubing 18 passes over the closing mechanism 25, thereby isolating the mechanism 25 from the disposable objects to be packaged, reducing the need for constant cleaning of the mechanism 25. In this respect, one will appreciate that one of the prefered uses for the apparatus 10 of the present invention is the disposal of baby diapers.

The closing mechanism 25 comprises a fixed portion 27, which comprises a generally "C"-shaped member rigidly connected under the bottom annular flange 16 of the holder 15. Alternate types of connections are also possible for the fixed portion 27, including connection to an additional support member connected to the holder 15 or to another part of the top portion 3. The curved fixed portion 27 defines a rounded apex 29 which projects into the opening 13, as can be also seen in FIG. 7. The fixed portion 27 defines a receiving surface 28 downwardly inclined toward a movable portion 31 of the closing mechanism 25.

The movable portion 31 of the closing mechanism 25 is also generally "C"-shaped inside cross-section and is biased against the fixed portion 27 in a closed position shown in FIGS. 1-2 such as to generally close the opening 13 of the apparatus 10. The curved movable portion 31 defines a rounded apex 32 projecting into the opening 13, as can also be seen in FIG. 7. The movable portion 31 defines a receiving surface 34 downwardly inclined toward the fixed portion 27, the two receiving surfaces 28,34 forming a "V" directing an object therebetween. In the closed position, contact between the two portions 27,31, which in the embodiment shown is between the apex 32 of the movable portion and a bottom part of the fixed portion located below the apex 29 thereof. These portions are wave-shaped to provide comfort to the hand of a user person. It also provides good sealing of a plastic film tube 18 engaged or pinched therebetween.

The movable portion 31 is slidingly supported by a support 35 which includes a pair of spaced apart, generally vertical walls 39 extending downwardly from the holder 15, for example from the bottom flange 16, with the opening 13 being aligned therebetween. Each of the walls 39 has a bottom, angled edge 40. A bottom piece 41, which in the embodiment shown is integral with the fixed portion 27 but can alternately be independent therefrom, interconnects the bottom edges 40 of the two walls 39. The bottom piece 41 has a substantially "U"-shape including two wall members 43 connected at one end to the fixed portion 27 and interconnected at another end by a transverse member 45 (see FIG. 2). Each wall member 43 is connected to the bottom edge 40 of one of the walls 39 to define an angled slot 37 therebetween. In the embodiment shown, the slot 37 is angled at approximately 40° with respect to the horizontal, although any other working angle can meet the objects of the invention with appropriate modifications.

Referring particularly to FIG. 2, the movable portion 31 includes aligned pins 47 extending therefrom and engaging the slots 37, such that the movable portion 31 is slidingly movable along an angular direction defined by the slots 37. The distance between the transverse member 45 and the fixed portion 27 is such that the movable portion 31 can move between the closed position and an opened position (shown in FIG. 4) enough to let a disposable object 55 to pass between the portions 27,31.

As shown in FIG. 2, an elongated helical spring 49 is connected to and extends between the two pins 47 of the movable portion 31 and around the back of the fixed portion 27, such as to bias the movable portion 31 in the closed position. The concave shape of the back of the fixed portion 27 helps maintain the spring 49 aligned in a plane defined by the slots 37.

Alternately, the fixed portion 27 can be replaced by a portion movable opposite of the movable portion 31, the two being biased together in the closed position. Such a configuration could be, for example, two sliding members symmetrical with respect to one another about a vertical axis defined at the point of contact therebetween, such as two "C"-shaped members similar in configuration to the movable member 31 shown, two rollers, etc., which are slidable away from each other upon downwardly pushing an object thereon, and are biased together for example by being interconnected by one or a plurality of springs. However, such a mechanism includes additional parts and is not as reliable.

In order to assist the user in correctly placing the disposable object 55, the apparatus may further advantageously be provided with a ring 61 removably installed over the cassette 17, providing a downward shape around the openings 13, 19 which creates a funnel effect and guides the user's hand.

Referring particularly to FIG. 2, the apparatus 10 can further include, within the bin 1, an integrated cutting tool 50, which can be for example attached to the transverse member 45 of the support 35, and can include a blade 52 located between two spaced apart protective fingers 54 sized such as to prevent a user's finger from reaching the blade 52 but still allowing a portion of tubing 18 to be inserted between the fingers 54 to be cut on the blade 52.

In order to prepare the apparatus for use, and with reference to FIG. 1, a user person opens the cover 11, takes a leading edge 51 of flexible tubing 18, ties it into a knot 53 and pushes the knot 53 beyond the region 33, just beyond the closing mechanism 25. Alternately, the tube end with the knot 53 could be pulled down to the bottom of the bin 1, for example by pivoting and opening the top portion 3 such as to gain access to the enclosure 2, and pulling the tube end with the knot 53 through the closing mechanism 25 and beyond to the bottom of the bin. The top portion 3 is then re-engaged with the bottom portion 5. Accordingly a length of empty flexible tubing 18 extends to the bottom and is now ready to receive disposable objects 55 therein from the closing mechanism. Therefore, the film material is not pulled from the cassettes as disposable objects are placed into the tube.

Figure 3:
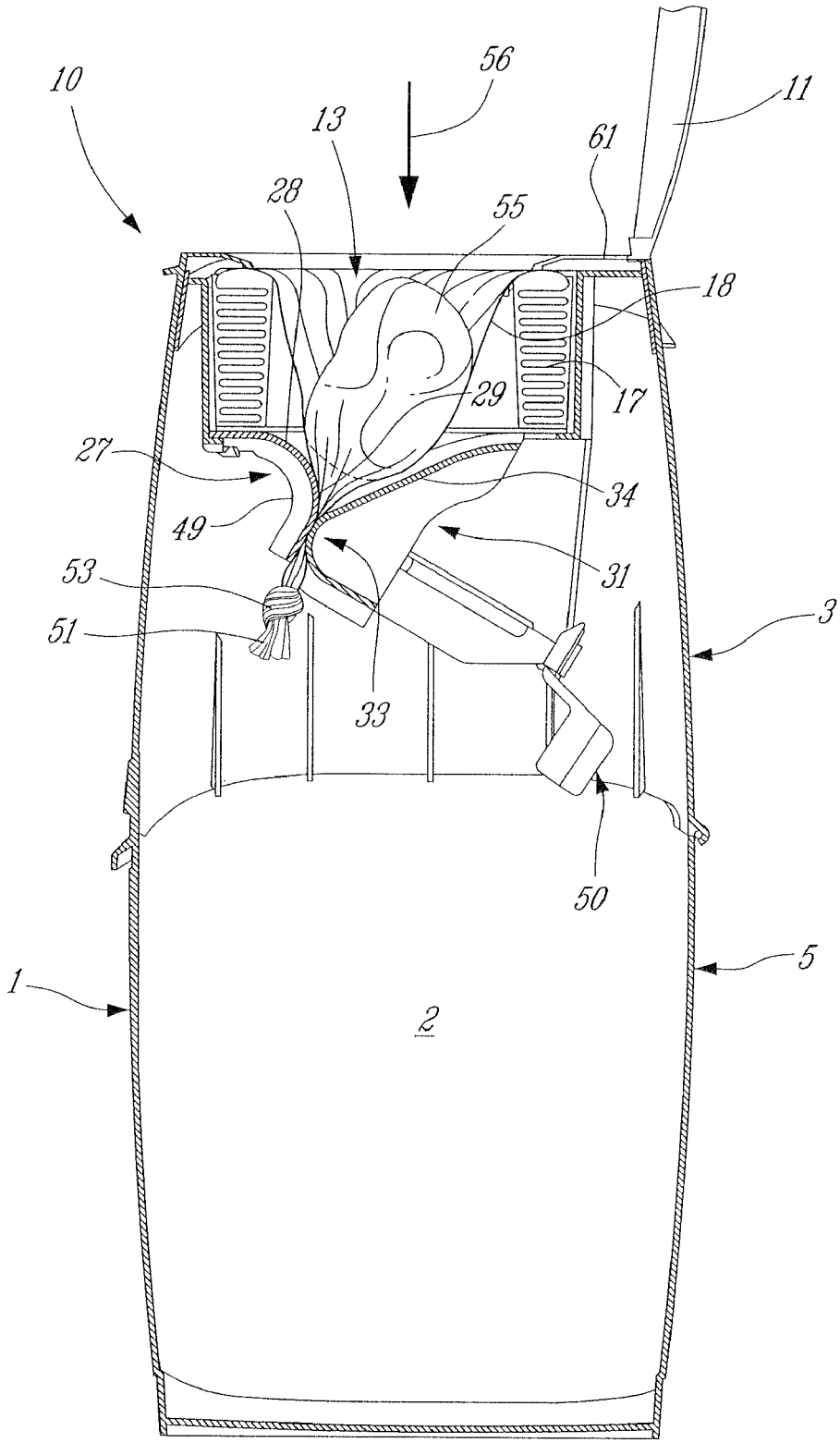
FIG. 3 is a cross-sectional view of the apparatus of FIG. 1, showing a step of the insertion of a disposable object within the apparatus.

In use and referring to FIG. 3, when a disposable object 55 needs to be packaged, the lid 11 of the apparatus 10 is lifted, thereby providing access to the opening 13. The disposable object 55 to be packaged is placed into the opening 13 (in this case, the cassette 17 of flexible tubing 18 surrounds the object 55). The receiving surfaces 28,34 of the fixed and movable portions 27,31 of the closing mechanism biased together in the closed position form a "V" which directs the disposable object 55 in the hand of a user person toward the contact region 33.

Figure 4:
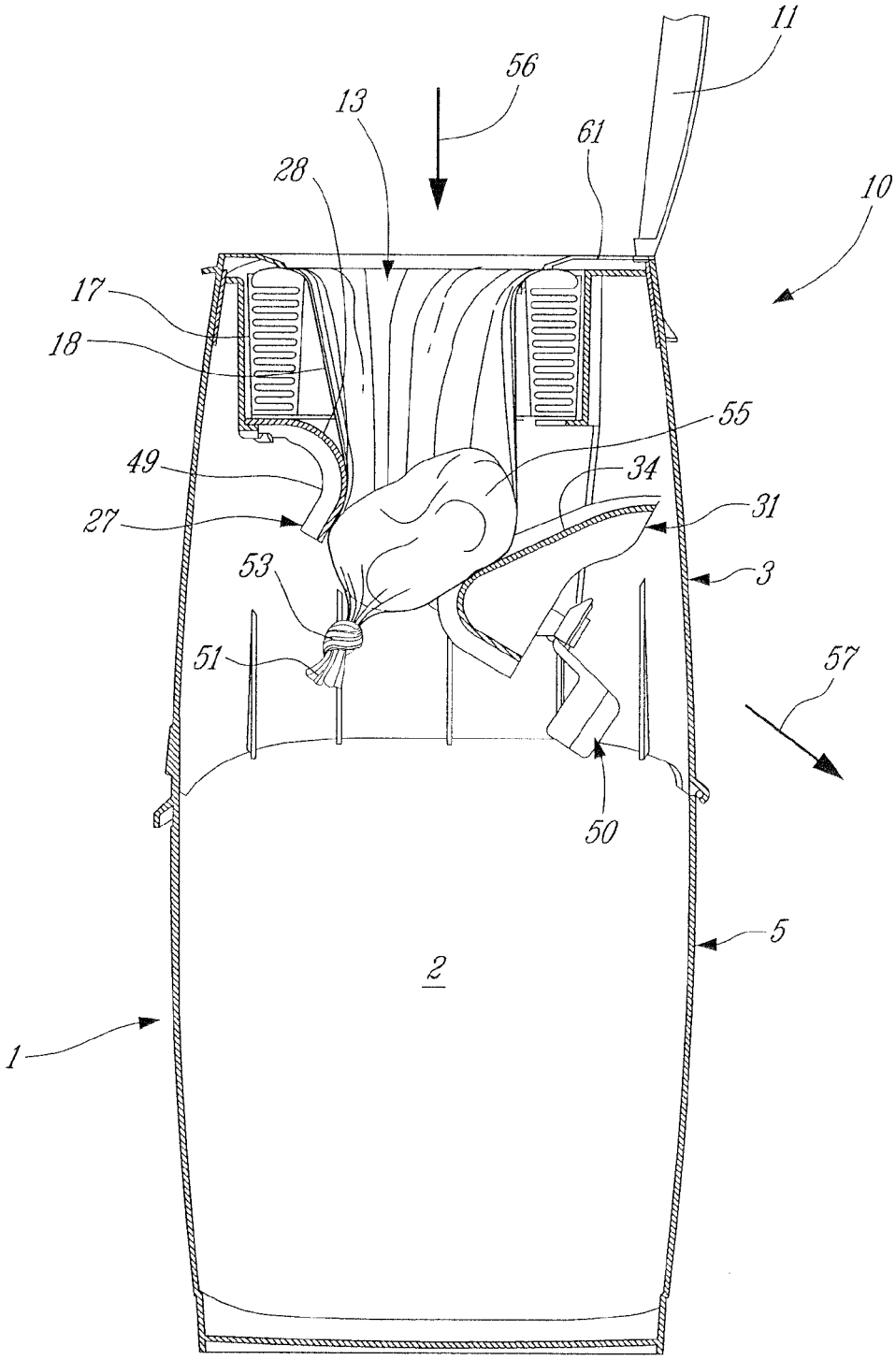
FIG. 4 is a cross-sectional view of the apparatus of FIG. 1, showing a step subsequent to that shown in FIG. 3 where a closing mechanism of the apparatus is moved in an open position by the insertion of the disposable object.
Figure 5:
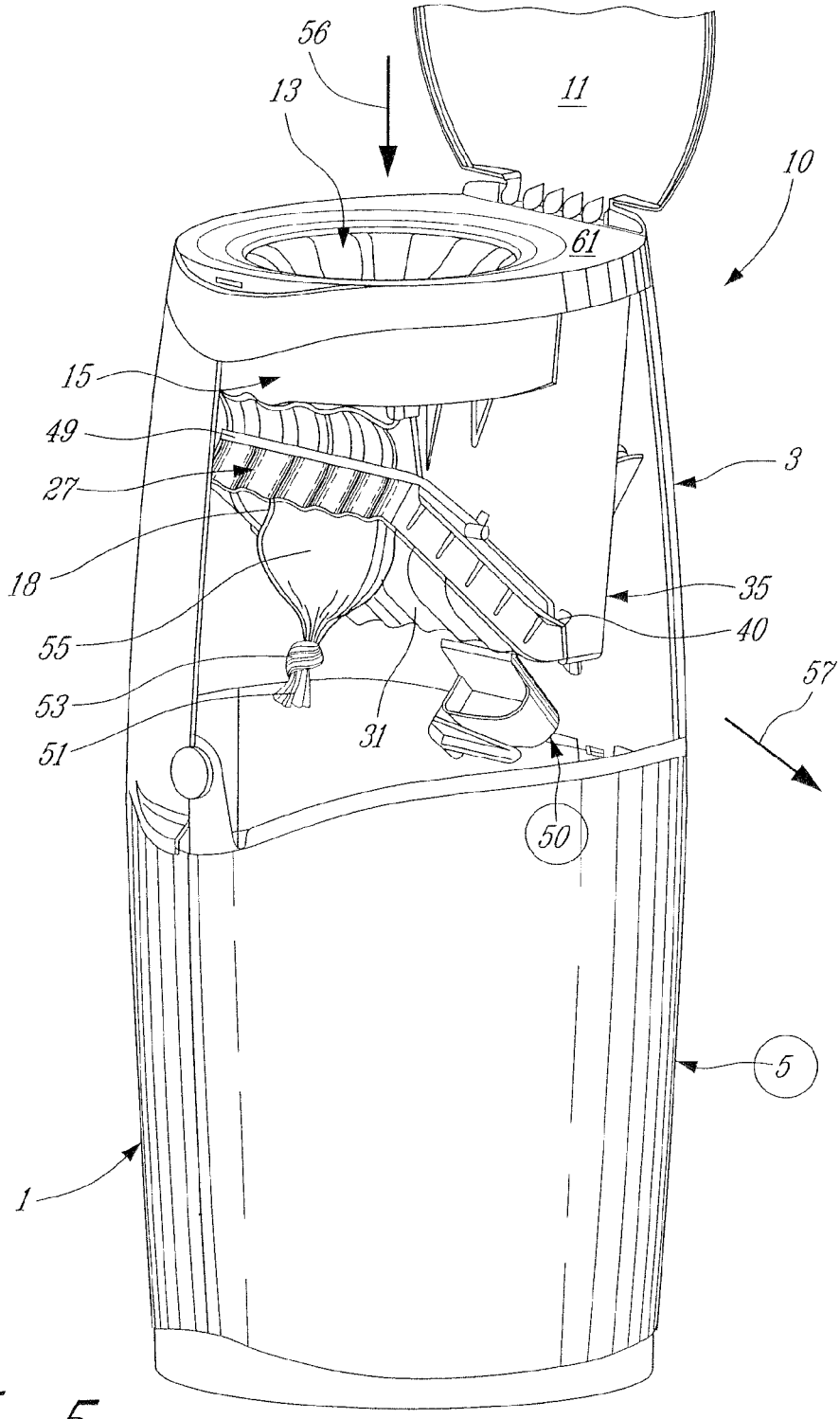
FIG. 5 is a perspective view of the apparatus and the step illustrate in FIG. 4, with part of an outer wall thereof being omitted.

As shown in FIGS. 3-5, the user person pushes the disposable object 55 in a downward direction as illustrated by arrow 56. The angled receiving surface 34 of the movable portion 31 helps the downward force to be easily converted along the direction of the slots 37 such as to force the movable portion 31 from its closed position in contact with the fixed portion 27 (FIG. 3) to its open position (FIGS. 4-5) against the force of the spring 49, through a sliding movement illustrated by arrow 57 in FIGS. 4-5. Since the movable portion 31 is moved by the force applied on the disposable object 55, it slides only enough for the disposable object 55 to go through, with most of the opening created by the movement of the movable portion 31 being blocked by the disposable object 55 such as to minimize the propagation of odors through the opening 13.

Figure 6:
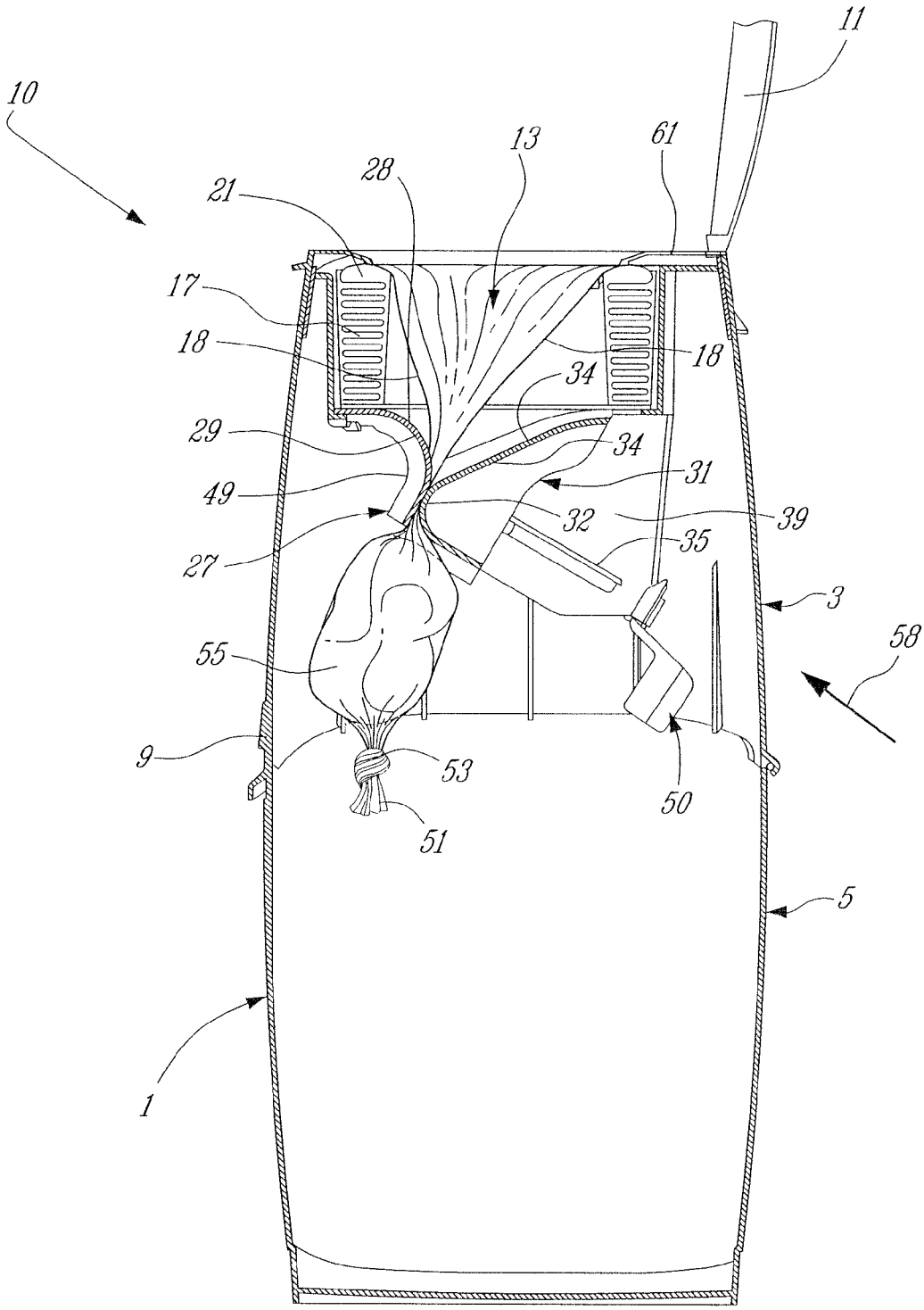
FIG. 6 is a cross-sectional view of the apparatus of FIG. 1, showing a step subsequent to that shown in FIG. 4 where the closing mechanism is moved back in a closed position.

Referring now to FIG. 6, once the disposable object 55 passes beyond the apex 32 of the movable portion 31, the user person releases the disposable object 55 and withdraws his or her hand. The movable portion 31, under the action of the spring 49, rapidly returns to the closed position through a sliding movement illustrated by arrow 58, effectively sealing the object 55 within the flexible tubing 18. The curved profile of the fixed portion 27 below the apex 29 and more importantly of the movable portion 31 below the apex 32 help push the disposable object 55 further down, if there is resistance, as the movable portion 31 returns to the closed position to apply a downward pushing force. Of course, if a tube has been drawn out the disposable objects face down by gravity into the tube, as previously described.

For each new disposable object 55 to be packed, the process is repeated, each time either dropping the disposable object within the already drawn length of flexible tubing 18 within the enclosure 2, or drawing out an additional length of flexible tubing 18 to accommodate another disposable object as the disposable object moves down into the tube inside the apparatus 10, until the enclosure 2 is full, containing an object-filled segment of flexible film tubing 18. The top portion 3 is pivoted away from the bottom portion 5. The flexible tubing 18 is then cut, for example by using the cutting tool 50 provided, and then tied to form a substantially sealed pouch which can be removed from the bin 1. The top portion 3 is pivoted back into engagement with the bottom portion 5 to use the apparatus 10 again as described above.

Figure 8:
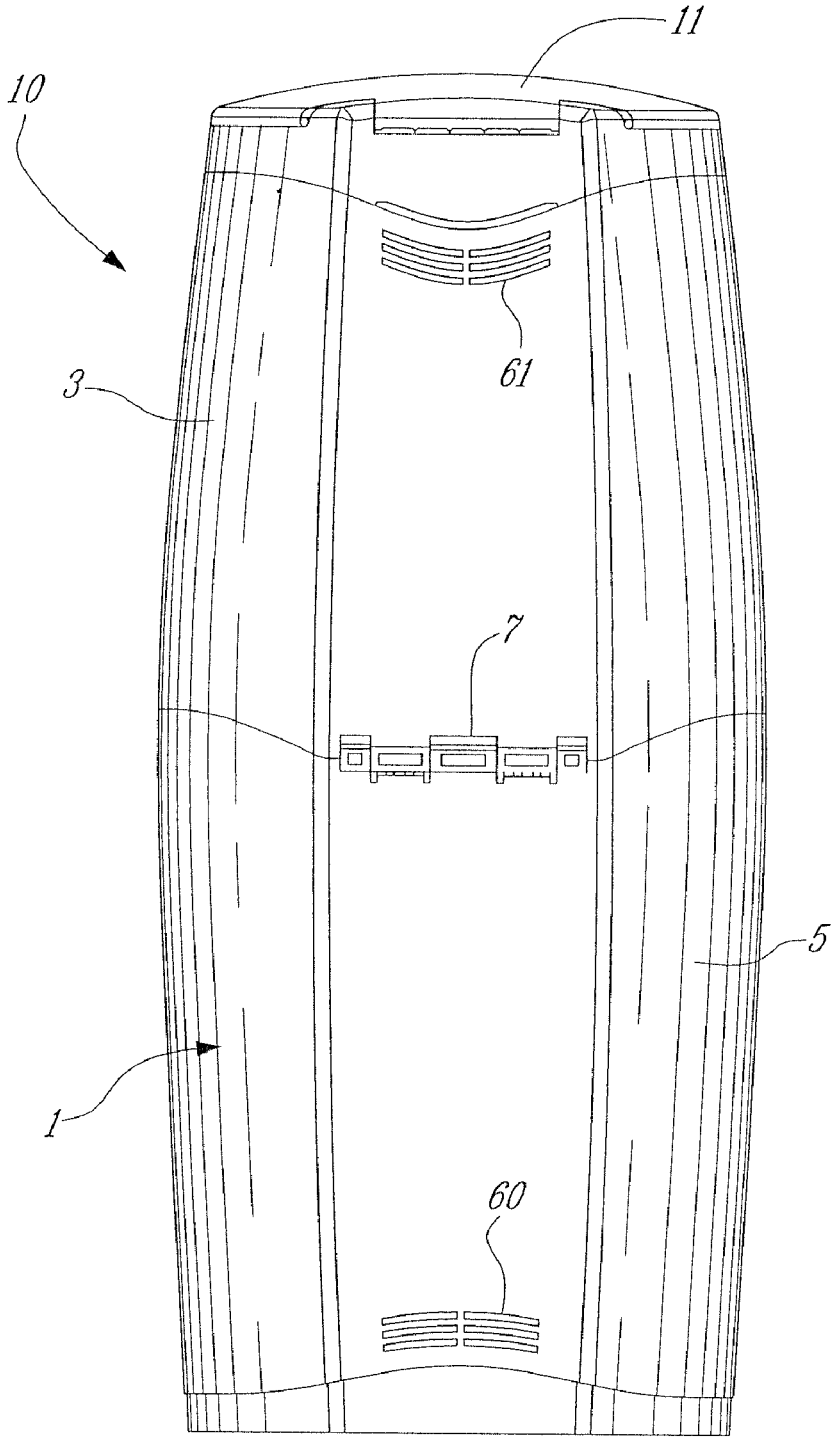
FIG. 8 is a rear view of the apparatus illustrating a venting feature thereof.

As mentioned hereinabove, by using plastic film cassettes wherein the film has an odor barrier greatly reduces accumulated light odors within the bin, when in use. However, when the top portion 3 of the bin is opened to remove a filled tubing segment, accumulated light odors are released and this can create a foul smell. In order to prevent accumulation of such light odors, the apparatus can be provided with vent slots 60 and 61 located at a bottom end and near a top end, respectively, of the unit as shown in FIG. 8 or at any other convenient locations. This provides for constant venting should there be an escape of odor about the film tube. Accordingly, foul odors cannot accumulate to increase the concentration thereof which would be released by opening the top portion 3 of the bin.

Advantages of the present invention include the use of a wedge-type closing mechanism 25 of simple construction with few parts to seal the flexible tubing 18. The mechanism 25 greatly reduces the complexity of the apparatus 10, makes the assembly simple, and allows for the use of a lesser quantity of flexible tubing 18 than prior art devices. Furthermore, angling the course of the movable portion 31 permits the optimization of little horizontal clearance versus the force required to bias the movable portion 31. Finally, the shape of the individual portions of the mechanism (as seen in cross-section), prevent disposable objects from "coming back up"—that is, once a disposable object has been inserted under pressure to pull film material, it will be forced to remain in the flexible tubing by the closing mechanism.

Figure 7:
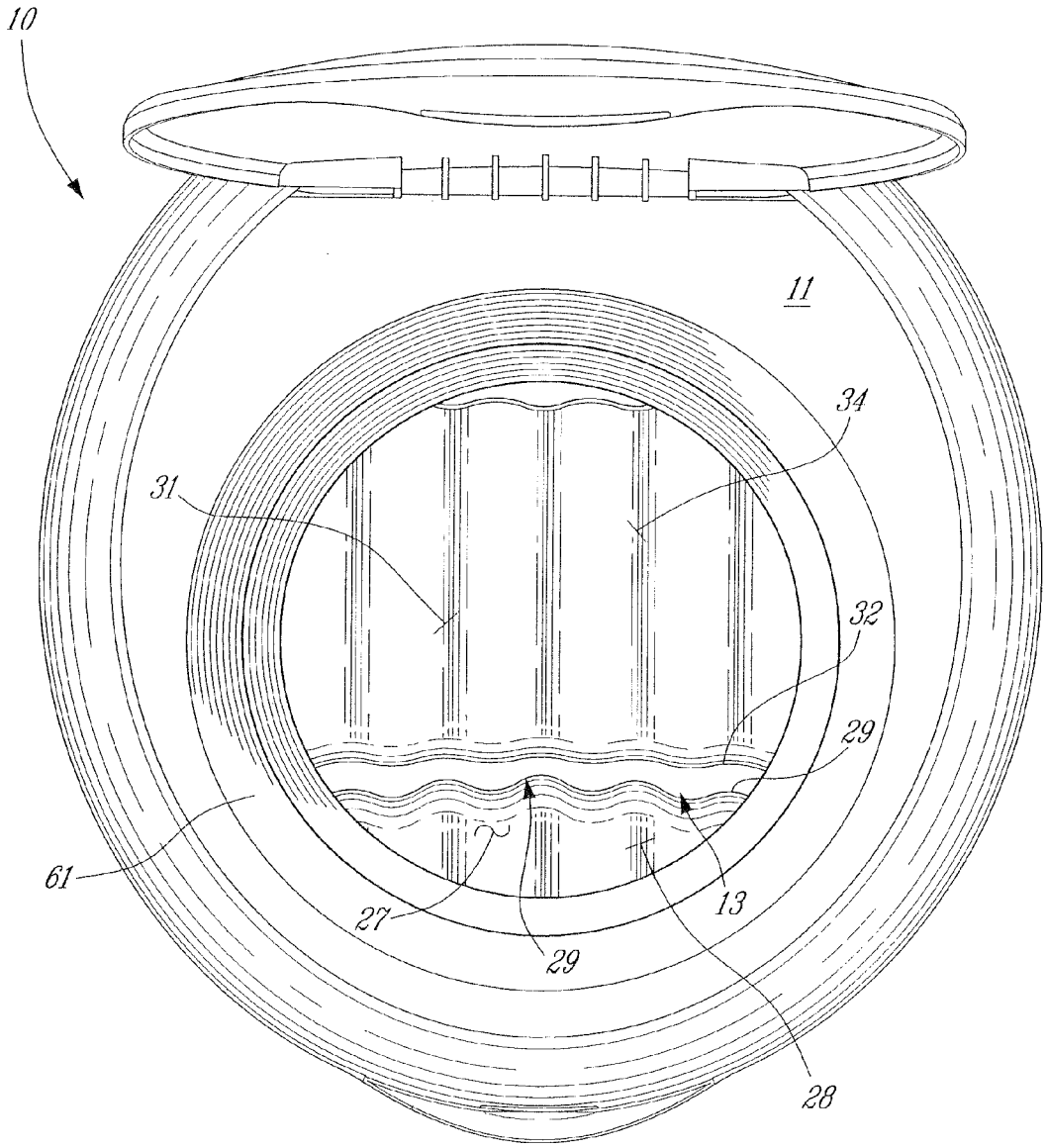
FIG. 7 is a top view of the apparatus of FIG. 1 with the closing mechanism located between the open and closed positions.

As above mentioned, the portions 31 and 27, particularly the receiving surfaces 28,34 have alternating rounded peaks and valleys, which are roughly sized to mate a human finger, permitting ease of entry of the disposable object into the flexible tubing with a hand, as shown in FIG. 7.

The embodiment of the present invention described above is intended to be exemplary. Those skilled in the art will therefore appreciate that the foregoing description is illustrative only, and that various alternate configurations and modifications can be devised without departing from the spirit of the present invention. Accordingly, the present invention is intended to embrace all such configurations, modifications and variances which fall within the scope of the appended claims.

The invention claimed is:

1. An apparatus for packing at least one disposable object into an elongated tube of flexible material, comprising:

a bin defining an enclosure with an opening defined at a top thereof for receiving at least one disposable object to be packed;

a holder within the bin proximate the opening, the holder being adapted to receive a cassette of flexible unfoldable film providing an elongated film tube; and a closing mechanism located below the holder comprising first and second portions, the second portion being biased in a closed position against the first portion and defining a receiving surface for receiving the at least one disposable object, the second portion being slidable in translation along a support from the cloned position to an open position through application of a vertical force against the receiving surface and being slidable in translation along the support from the open position to the closed position under the action of biasing means, the closing mechanism in the open position defining a passage between the opening of the bin and a bottom portion of the enclosure located below the closing mechanism, the closing mechanism in the closed position closing the said passage.

2. The apparatus according to claim 1, wherein the first portion is retained stationary with respect to the bin.

3. The apparatus according to claim 2, wherein the first portion is connected to a bottom portion of the holder.

4. The apparatus according to claim 1, wherein the biasing means include at least one spring interconnecting the first and second portions.

5. The apparatus according to claim 1, wherein the first portion is curved and defines a first rounded apex and the second portion is curved and defines a second rounded apex, the first apex extending toward the second portion and the second apex extending toward the first portion.

6. The apparatus according to claim 5, wherein in the closed position the second apex contacts the first portion below the first rounded apex.

7. The apparatus according to claim 1, wherein the second portion is slidably supported by a support connected to the holder.

8. The apparatus according to claim 1, wherein the holder comprises a first annular flange extending inwardly from an outer wall of the bin, a tubular wall extending downwardly from an inner end of the first annular flange, and a second annular wall extending inwardly from a bottom end of the tubular wall, thus forming a seat for receiving the cassette.

9. The apparatus according to claim 1, wherein the bin includes a top portion and a bottom portion hingedly connected to each other, the closing mechanism being connected to the top portion.

10. The apparatus according to claim 1, wherein the receiving surface of the second portion has alternating rounded ridges and valleys, said first portion having alternating rounded ridges and valleys in at least a portion thereof which is in contact with said second portion and disposed for meshing relationship therewith.

11. The apparatus according to claim 1, wherein the second portion is slidable along a direction angled downwardly with respect to an horizontal plane.

12. The apparatus according to claim 11 wherein the first portion is curved and defines a first rounded apex and the second portion is curved and defines a second rounded apex, the first apex extending toward the second portion and the second apex extending toward the first portion, wherein in the closed position the second apex contacts the first portion below the first rounded apex, such that the curved portion of the second portion in a lower part of said rounded apex provides a downward pushing force against a disposable object supported in contact therewith.

13. The apparatus according to claim 11, wherein the direction forms an angle of approximately 40° with the horizontal plane.

14. The apparatus according to claim 1, wherein the opening of the bin is surrounded by a removable ring having a downward slope for creating a funnel effect into the opening.

15. An apparatus for packing at least one disposable object into an elongated tube of flexible material, comprising:

a bin having an opening defined at a top portion thereof;

a cassette holder located proximate the top portion of the bin;

a removable cassette or unfoldable tubing of flexible material received in the cassette holder, the tubing being pullable from the cassette and attached to form a closed bottom for an elongated tube of increasing length having an open top end aligned with the opening for receiving the at least one disposable object within the elongated tube; and a closing mechanism located below the holder comprising at least one moveable part biased in a closed position and slidable in translation along a support between the closed position and an open position by pushing the at least one disposable object against the closing mechanism, the closing mechanism in the closed position pinching the flexible material such as to seal a portion of the elongated tube from a remainder of the elongated tube below the closing mechanism, the closing mechanism in the open position allowing the disposable object to be pushed within the bin below the closing mechanism.

16. The apparatus according to claim 15, further comprising a fixed part, the movable part being biased against the fixed part by at least one spring.

17. The apparatus according to claim 15, wherein the movable portion is curved and defines a rounded apex, the movable portion in the closed position pinching the elongated tube between the apex and a fixed part of the closing mechanism.

18. The apparatus according to claim 15, wherein the holder comprises a first annular flange extending inwardly from an outer wall of the bin, a tubular wall extending downwardly from an inner end of the first annular flange, and a second annular wall extending inwardly from a bottom end of the tubular wall, thus forming a seat for receiving the cassette.

19. The apparatus according to claim 15, wherein the movable part is slidable along a direction angled with respect to an horizontal plane.

20. The apparatus according to claim 19, wherein the direction forms an angle of approximately 40° with the horizontal plane.

21. The apparatus of claim 1 or 15 wherein a housing of said apparatus is provided with vent openings to prevent the accumulation of odors.

22. An apparatus for packing at least one disposable object into an elongated tube of flexible material, comprising:

a bin defining an enclosure with an opening defined at a top thereof for receiving at least one disposable object to be packed;

a holder within the bin proximate the opening, the holder being adapted to receive a cassette of flexible unfoldable film providing an elongated film tube; and a closing mechanism located below the holder comprising first and second portions, the second portion being biased in a closed position against the first portion and defining a receiving surface for receiving the at least one disposable object, the second portion being slidable from the closed position to an open position through application of a vertical force against the receiving surface and being slidable from the open position to the closed position under the action of biasing means, the closing mechanism in the open position defining a passage between the opening of the bin and a bottom portion of the enclosure located below the closing mechanism, the closing mechanism in the closed position closing the said passage, with the first portion being retained stationary with respect to the bin.

23. An apparatus for packing at least one disposable object into an elongated tube of flexible material, comprising:

a bin defining an enclosure with an opening defined at a top thereof for receiving at least one disposable object to be packed;

a holder within the bin proximate the opening, the bolder being adapted to receive a cassette of flexible unfoldable film providing an elongated film tube; and a closing mechanism located below the holder comprising first and second portions, the second portion being biased in a closed position against the first portion and defining a receiving surface for receiving the at least one disposable object, the second portion being slidable along a direction angled downwardly with respect to a horizontal plane from the closed position to an open position through application of a vertical force against the receiving surface and being slidable from the open position to the closed position under the action of biasing means, the closing mechanism in the open position defining a passage between the opening of the bin and a bottom portion of the enclosure located below the closing mechanism, the closing mechanism in the closed position closing the said passage.

* * * * *